US008800688B2

(12) United States Patent
John et al.

(10) Patent No.: US 8,800,688 B2
(45) Date of Patent: Aug. 12, 2014

(54) DOWNHOLE MOTORS WITH A LUBRICATING UNIT FOR LUBRICATING THE STATOR AND ROTOR

(75) Inventors: Hendrik John, Celle (DE); Harald Grimmer, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 355 days.

(21) Appl. No.: 13/187,250

(22) Filed: Jul. 20, 2011

(65) Prior Publication Data

US 2013/0020132 A1 Jan. 24, 2013

(51) Int. Cl.
*E21B 4/02* (2006.01)

(52) U.S. Cl.
USPC ..... 175/107; 175/57; 418/91; 418/97; 415/176

(58) Field of Classification Search
USPC ..... 175/107, 57; 418/48, 49, 50, 52, 53, 84, 418/88, 97, 99, 100; 417/228, 366–371; 415/903, 176, 110, 112
See application file for complete search history.

(56) References Cited

U.S. PATENT DOCUMENTS

| | | | | |
|---|---|---|---|---|
| 2,241,718 | A * | 5/1941 | Meixsell | 418/100 |
| 3,365,170 | A * | 1/1968 | Whittle | 415/69 |
| 3,764,234 | A * | 10/1973 | Morgan et al. | 418/84 |
| 3,868,929 | A * | 3/1975 | Ishikawa | 123/207 |
| 3,894,818 | A | 7/1975 | Tschirky | |
| 3,923,435 | A * | 12/1975 | Jones | 418/100 |
| 4,059,086 | A * | 11/1977 | Tsubouchi | 123/196 R |
| 4,080,119 | A * | 3/1978 | Eriksson | 418/97 |
| 4,086,040 | A * | 4/1978 | Shibuya et al. | 418/76 |
| 4,114,703 | A | 9/1978 | Matson, Jr. et al. | |
| 4,114,704 | A | 9/1978 | Maurer et al. | |
| 4,225,000 | A | 9/1980 | Maurer | |
| 4,246,976 | A | 1/1981 | McDonald, Jr. | |
| 4,256,189 | A | 3/1981 | Fox et al. | |
| 4,260,031 | A * | 4/1981 | Jackson, Jr. | 175/107 |
| 4,284,149 | A | 8/1981 | Fox | |
| 4,307,889 | A * | 12/1981 | Piazza | 277/322 |
| 4,324,299 | A | 4/1982 | Nagel | |
| 4,329,127 | A | 5/1982 | Tschirky et al. | |
| 4,497,185 | A * | 2/1985 | Shaw | 62/468 |
| 4,548,283 | A | 10/1985 | Young | |
| 4,678,045 | A * | 7/1987 | Lyons | 175/61 |
| 4,780,061 | A * | 10/1988 | Butterworth | 417/371 |
| 5,517,464 | A * | 5/1996 | Lerner et al. | 367/84 |

(Continued)

FOREIGN PATENT DOCUMENTS

| | | | |
|---|---|---|---|
| FR | 2696792 | A1 | 4/1994 |
| GB | 2261238 | A | 5/1993 |

(Continued)

OTHER PUBLICATIONS

International Search Report and Written Opinion for International Application No. PCT/US2012/041678.

*Primary Examiner* — Blake Michener
(74) *Attorney, Agent, or Firm* — Cantor Colburn LLP

(57) ABSTRACT

In aspects, the disclosure provides a drilling motor that includes a lubricating unit that selectively supplies a lubricant to the drilling fluid before the drilling fluid passes through the drilling motor so as to lubricate the stator and/or the rotor to reduce friction between the stator and the rotor and to reduce wear of the motor.

21 Claims, 4 Drawing Sheets

(56) References Cited

U.S. PATENT DOCUMENTS

| | | | | |
|---|---|---|---|---|
| 5,653,585 | A * | 8/1997 | Fresco | 418/100 |
| 5,679,894 | A | 10/1997 | Kruger et al. | |
| 6,338,388 | B1 | 1/2002 | Winkler | |
| 6,424,066 | B1 | 7/2002 | Watson et al. | |
| 6,520,271 | B1 | 2/2003 | Martini | |
| 6,568,489 | B1 * | 5/2003 | Hailey | 175/228 |
| 6,761,544 | B2 | 7/2004 | McCartney | |
| 7,549,487 | B2 | 6/2009 | LeBlanc et al. | |
| 7,896,551 | B2 | 3/2011 | Cooley et al. | |
| 7,975,780 | B2 * | 7/2011 | Siher et al. | 175/57 |
| 8,454,334 | B2 * | 6/2013 | Heger et al. | 418/84 |
| 2004/0069535 | A1 | 4/2004 | Hahn et al. | |
| 2006/0254819 | A1 | 11/2006 | Moriarty | |
| 2009/0152009 | A1 | 6/2009 | Slay et al. | |
| 2009/0288818 | A1 | 11/2009 | Brown et al. | |
| 2010/0034684 | A1 * | 2/2010 | Ast et al. | 418/84 |
| 2013/0209299 | A1 * | 8/2013 | Santos et al. | 418/1 |
| 2014/0050594 | A1 * | 2/2014 | Schlenhoff et al. | 417/53 |

FOREIGN PATENT DOCUMENTS

| | | | |
|---|---|---|---|
| GB | 2354787 | A | 4/2001 |
| RU | 2310071 | C2 | 11/2007 |
| WO | WO9816712 | A1 | 4/1998 |

* cited by examiner

DOWNHOLE MOTORS WITH A LUBRICATING UNIT FOR LUBRICATING THE STATOR AND ROTOR

BACKGROUND INFORMATION

1. Field of the Disclosure

This disclosure relates generally to drilling motors for use in drilling wellbores.

2. Brief Description of the Related Art

To obtain hydrocarbons such as oil and gas, boreholes or wellbores are drilled by rotating a drill bit attached to a drill string end. A substantial proportion of the current drilling activity involves drilling deviated and horizontal boreholes to increase the hydrocarbon production and/or to withdraw additional hydrocarbons from the earth's formations. Modern directional drilling systems generally employ a drill string having a drill bit at the bottom that is rotated by a positive displacement motor (commonly referred to as a "mud motor" or a "drilling motor"). A typical mud motor includes a power section that contains a stator and a rotor disposed in the stator. The stator typically includes a metal housing lined inside with a helically contoured or lobed elastomeric material. The rotor is typically made from a metal, such as steel, and has an outer lobed surface. Some mud motors include a metallic stator and a metallic rotor. Pressurized drilling fluid (commonly known as the "mud" or "drilling fluid") is pumped into a progressive cavity formed between the rotor and stator lobes. The force of the pressurized fluid pumped into the cavity causes the rotor to turn in a planetary-type motion. The friction between the stator and the rotor results in wear of the contact surfaces and loss of efficiency of the motor.

The disclosure herein provides drilling motors that include a lubricating unit configured to supply a lubricant to the stator and rotor during operation of the drilling motor.

SUMMARY

In one aspect, the disclosure provides apparatus that in one embodiment includes a stator, a rotor disposed in the stator and a lubricating unit configured to supply a lubricant to the rotor and the stator when the rotor rotates in the stator. In another aspect, the lubricating unit may include a control unit configured to control the supply of a lubricant.

In another aspect, a method of using a downhole apparatus is disclosed that in one embodiment includes providing a stator, providing a rotor in the stator, discharging a lubricant from a lubricating unit to lubricate the stator and the rotor when the rotor rotates in the stator.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE EMBODIMENTS

Figure 1:
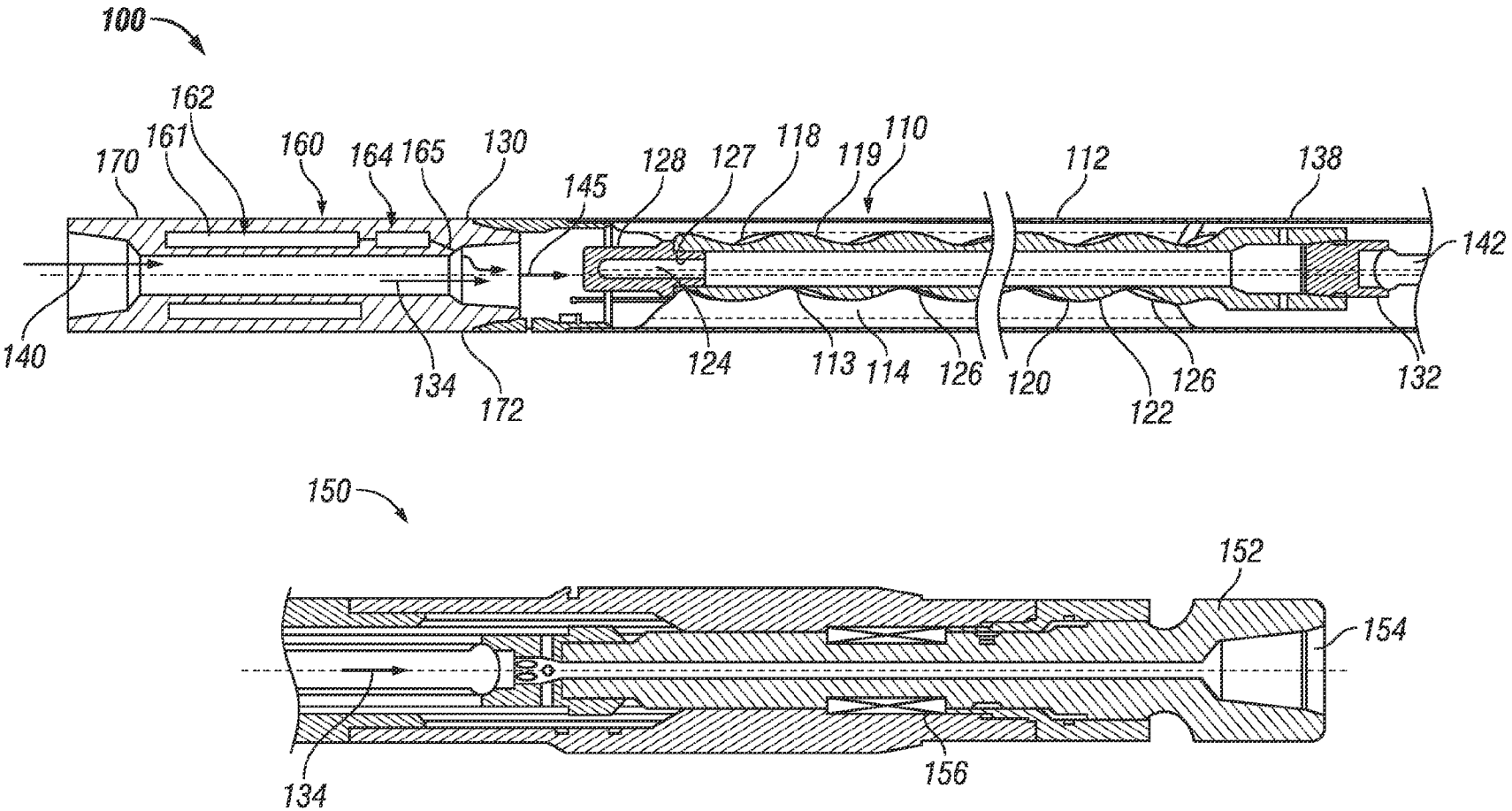
FIG. 1 is a cross-section of a drilling motor that includes a lubricating unit in the drilling motor according to one embodiment of the disclosure.

FIG. 1 shows a cross-section of an exemplary drilling motor 100 that includes a power section 110 and a bearing assembly 150. The power section 110 contains an elongated metal housing 112 having therein an elastomeric stator 114 that includes lobes 118. The stator 114 is secured inside the housing 112 or formed integral with the housing 112. A rotor 120 made of a suitable metal or an alloy includes lobes 122.The rotor 120 is rotatably disposed inside the stator 114. The stator 114 includes one lobe more than the number of rotor lobes. In aspects, the rotor 120 may have a bore 124 that terminates at a location 127 below the upper end 128 of the rotor 120 as shown in FIG. 1. The bore 124 remains in fluid communication with the drilling mud 140 below the rotor 120 via a port 138. The rotor lobes 122, stator lobes 118 and their helical angles are such that the rotor 120 and the stator 114 seal at discrete intervals, resulting in the creation of axial fluid chambers or cavities 126 that are filled by the pressurized drilling fluid or mud 140 when such fluid is supplied to the motor 100 from the surface during drilling of a wellbore. The pressurized drilling fluid 140 (shown by arrow 134) flows through cavities 126, which causes the rotor 120 to rotate within the stator 114. The design and number of the lobes 118 and 122 define the output characteristics of the drilling motor 100. In one configuration, the rotor 120 is coupled at end 132 to a flexible shaft 142 that connects to a rotatable drive shaft 152 in the bearing assembly 150. A drill bit (not shown) in connected to a bottom end of the bearing assembly at a suitable bit box 154. During a drilling operation, the pressurized fluid 140 rotates the rotor 120 that in turn rotates the flexible shaft 142. The flexible shaft 142 rotates the drill shaft 152, which, in turn, rotates the bit box 154 and thus the drill bit. During operation, the rotor 120 comes in contact with the stator 114. The friction between the rotor 120 and the stator 114 reduces the efficiency of the drilling motor 100.

FIG. 1 further shows a subassembly 170 connected to the drilling motor 100 at an upper end 134 of the drilling motor with a box connection 172. The sub 170 includes a lubricating unit 160 that includes a reservoir (lubricant source) 162 for storing a lubricant 161 therein and a lubricant supply unit (also referred to as a dozing unit) 164. During operation of the drilling motor 100, the supply unit 164 pumps the fluid 161 from the reservoir 162 into the flow of the drilling fluid 140 at the joint 172 via line 165. The combined fluid 145 (mixture of drilling fluid 140 and lubricant 161) flows through the cavities 126 between the rotor 120 and stator 114, which lubricates the inner surface 113 of the stator 114 and the outer surface 119 of the rotor 120. In this configuration, the lubricant 161 can lubricate the entire inner length of the inner surface 113 of the stator 114 and the entire outer surface 119 of the rotor 120. The mixture 145 flows from the power section 110 to the bearing assembly section 150, which lubricates the radial and axial bearings 156 before discharging to the drill bit via box 154. In aspects, the lubricating unit 160 supplies or discharges the lubricant into the drilling fluid 140 in response to one or more parameters, which parameters may include, but, are not limited to, time periods, speed of the drilling motor, load on the drilling motor, differential pressure across the power section 110.

Still referring to FIG. 1, the lubricant may be any suitable surface active material or may include one or more surface active materials. In one aspect, the lubricant 161 may form a film on the inner surface 113 of the stator 114 and/or the outer surface 119 of the rotor 120. Such materials reduce the friction between the stator inner surface 113 and the rotor outer surface 119. The film can also be effective in reducing friction and wear in drilling motors employing elastomer-free drilling motors, which motors are designed to operate at high temperatures, such as 450 degrees Fahrenheit or above. Such lubricating apparatus can also be beneficial for air-drilling applications, such as those utilize nitrogen and liquid soap, for example. The lubricant 161 may be a suitable liquid or comprise solid particles or a mixture of both. An exemplary lubricating unit is described in more detail in reference to FIG. 4.

Figure 2:
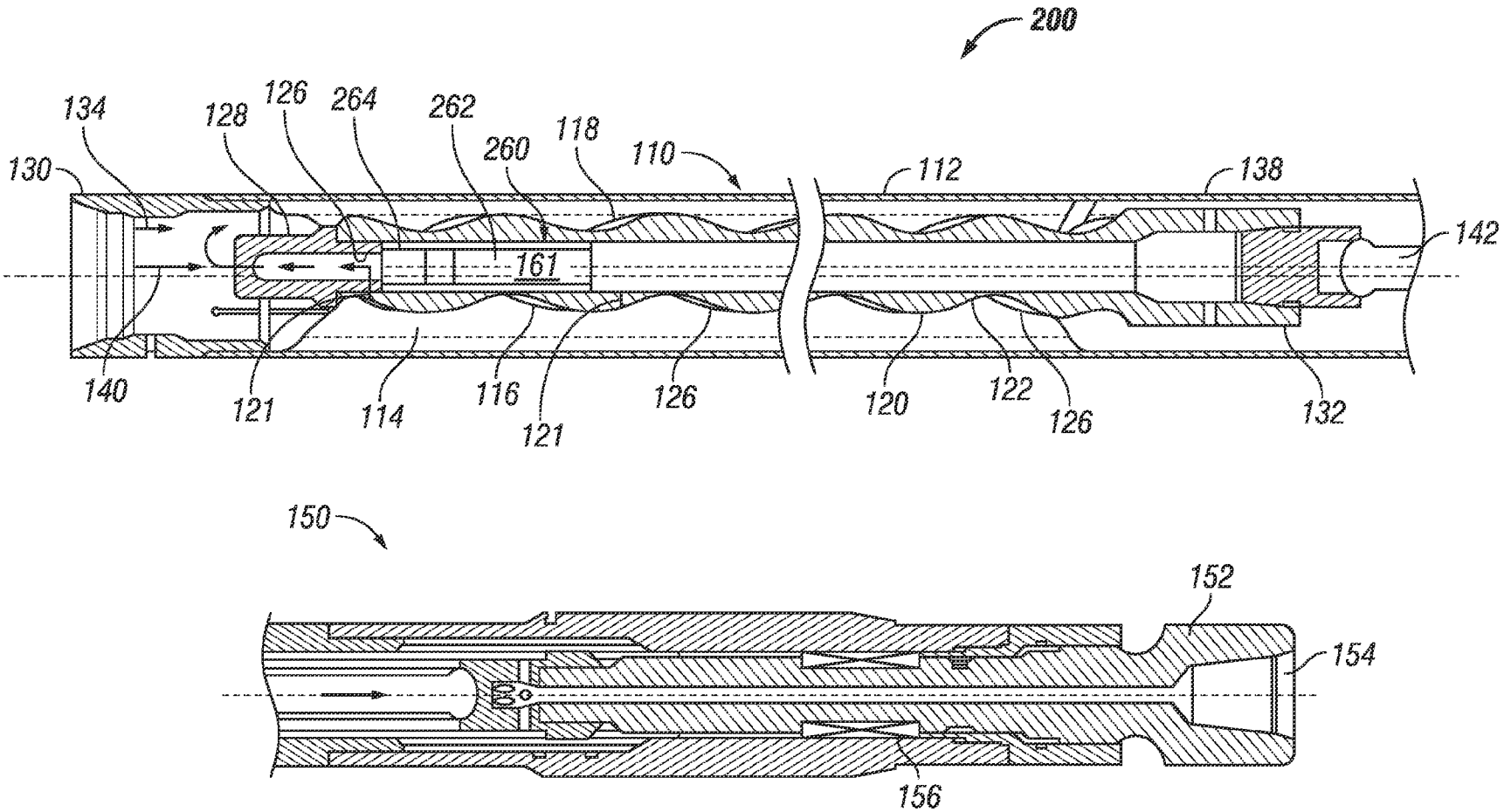
FIG. 2 is a cross-section of a drilling motor that includes a lubricating unit in the drilling motor according to another embodiment of the disclosure.

FIG. 2 is a cross-section of a drilling motor 200 that includes a lubricating unit in the rotor of the drilling motor, according to another embodiment of the disclosure. The drilling motor 200 includes a power section 110 and a bearing section 150. In the embodiment shown in FIG. 2, the lubricating unit 260 is placed in the rotor 120 of the drilling motor 200. The lubricating unit 260 includes a lubricant reservoir 262 and a supply control unit 264 that controls the supply of lubricant 161 to the drilling fluid 140 flowing into the drilling motor 110. In this configuration, the supply control unit 264 pumps the lubricant 161 proximate to the upper section 130 of the drilling motor 200, where the lubricant 161 mixes with the drilling fluid 140 and passes through the cavities 126 of the drilling motor 200. In another aspect, lubricant 161 may be discharged between the rotor and the stator via one or more passages made in the rotor 120, such as passage 121 shown in FIG. 2. In aspects, one or more such passages may be provided along the length of the rotor 120. Such a direct discharge of the lubricant 161 between the rotor and stator may utilize a lesser amount of the lubricant compared to discharging the lubricant at a location above the power section, such as shown in FIG. 1.

Figure 3:
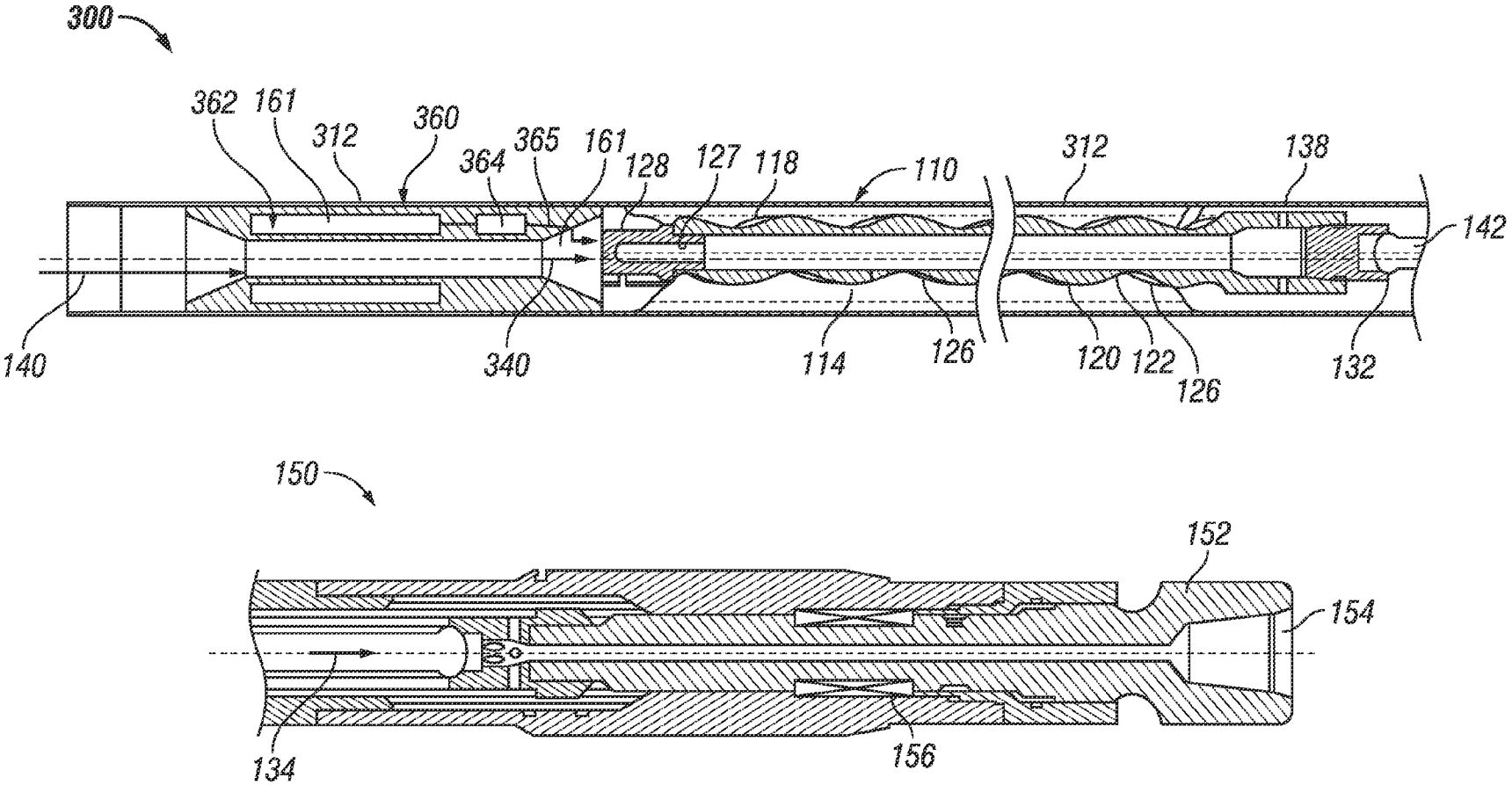
FIG. 3 shows a block functional diagram of a control unit of the lubricant unit configured to control the supply of the lubricant to the rotor and the stator.

FIG. 3 is a cross-section of a drilling motor 300 that includes a lubricating unit 360 in a stator housing, according to yet another embodiment of the disclosure. The drilling motor 300 includes a power section 110 and a bearing section 150. The housing 312 of the drilling motor 300 is elongated at its top end compared to the housing 112 shown in FIGS. 1 and 2. In the embodiment shown in FIG. 3, the lubricating unit 360 is placed in the upper end of the housing 312. The lubricating unit 360 includes a lubricant reservoir 362 and a lubricant supply control unit 364 that controls the supply of lubricant 161 to the drilling fluid 140 flowing into the drilling motor 300. In this configuration, the supply control unit 364 pumps the lubricant 161 from the reservoir 364 via line 365 to a location 340 where the drilling fluid 140 enters into the power section 110. The lubricant 161 mixes with the drilling fluid 140 proximate to the upper end of the power section 110 and enters the cavities 126 of the drilling motor 300. Mixing the lubricant proximate to the location where the drilling fluid enters the power section can be most efficient in lubricating the rotor and stator. Although FIGS. 1-3 describe the location of the lubricating unit at certain selected locations, such a lubricating unit, may be placed at any other suitable location to lubricate the stator and/or rotor.

Figure 4:
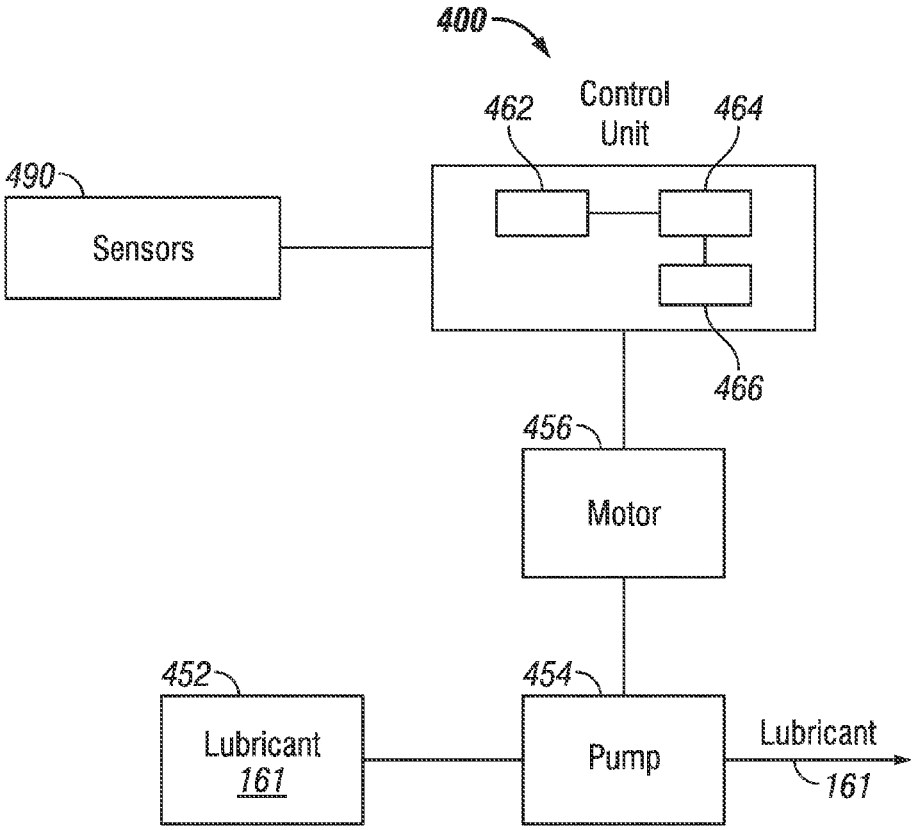
FIG. 4 shows a block functional diagram of an exemplary lubricant supply unit or system.

FIG. 4 shows a block functional diagram of an exemplary lubricant supply unit or system 400. The system 400, in one embodiment, may include a lubricant storage unit 452 for storing the lubricant 161, a pump 454 configured to pump the lubricant 161 from the storage unit 452 into the drilling fluid entering the drilling motor, and a motor 456 configured to drive the pump 454. The system 400 may further include controller 460 that includes a processor 462, such as microprocessor, configured to control the motor 456 in response to measurements received from sensors 490 and/or programmed instructions 466 stored in storage device 464 and accessible to the processor 462. In aspects, the control unit 460 may be placed at any suitable location, including, but not limited to, inside the rotor 120 (FIG. 2), in a sub, such as sub 160 (FIG. 1), in the stator housing, such as housing 312 (FIG. 3), in a bottomhole assembly (not shown) to which the drilling motor is coupled and/or at the surface. In aspects, the control unit 460 may communicate with control units in the bottomhole assembly and/or at the surface to control the supply of the lubricant 161 to the drilling motor. The power to the control unit 460 and the motor 456 may be provided from a source in a bottomhole assembly (not shown) that typically includes the drilling motor for drilling wellbores. The sensors 490 may be located at any suitable locations in the drilling motor or in the bottomhole assembly. During operation of the drilling motor, the control unit 460 controls the operation of system 400 in response to the sensor measurements and/or programmed instructions. Although, the concepts and lubricating methods herein are described in reference to drilling or mud motors, the disclosure herein applies to any positive displacement motor or Moineau device, including, but not limited to Moineau pumps. Such devices are known and are thus described in detail herein.

Thus, the disclosure provides a drilling motor that includes a lubricant (or device or apparatus) configured to discharge selected amounts of a lubricant to the drilling fluid before such fluid passes through the fluid cavities formed between the rotor and the stator, thereby causing the lubricant in the mixed fluid to lubricate the rotor and the stator, to reduce friction and wear of the drilling motor. The lubricating unit may be placed above the drilling motor, in the rotor or stator. In one aspect, the lubricating unit may discharge the lubricant between the stator and motor. In aspects, the lubricant may be any suitable lubricant, including, but not limited to (i) a liquid; (ii) solid particles; (iii) a mixture of a liquid and solid particles. The selected lubricant may form a film on the rotor outer surface and/or the stator inner surface to reduce the friction between the rotor and the stator. In another aspect, the lubricating unit includes may include a pump, a motor configured to drive the pump, and a control unit configured to operate the motor to selectively discharge the lubricant from the source thereof into a drilling fluid entering the drilling motor. The control unit may include a processor configured to control the discharge of the lubricant in response to a selected parameter. The parameter may include, but is not limited to (i) load on the drilling motor, (ii) flow of the drilling fluid through the drilling motor, and (iii) temperature at a selected downhole location.

In another aspect, the disclosure provides a method for utilizing a drilling motor for drilling a wellbore. In one configuration, the method may include: deploying the drilling motor in the wellbore wherein the drilling motor includes a rotor inside a stator; supplying a drilling fluid to the drilling motor to cause the rotor to rotate in the stator; and discharging a lubricant using a lubricating unit associated with the drilling motor into the drilling fluid to lubricate one of the stator and the rotor during use of the drilling motor in the wellbore. In one aspect, the method may further include placing the lubricating unit above the rotor, in the rotor, or the stator. In another aspect, the method may include discharging the lubricant between the stator and motor via passages in the rotor or stator. In aspects, a characteristic of the lubricant may be that it forms a film on one of the rotor and stator. In another aspect, the method may include controlling the discharge of the lubricant in response to a selected parameter. In aspects, the parameter may be any suitable parameter including, but not limited to: (i) load on the drilling motor; (ii) flow of the drilling fluid through the drilling motor; and (iii) temperature at a selected downhole location.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. An apparatus for use downhole, comprising:

a stator having an inner contour surface;

a rotor having an outer contour surface disposed in the stator, wherein the outer contour surface of the rotor comes in contact with the inner contour surface of the stator; and a lubricating unit configured to selectively discharge a lubricant from a reservoir source thereof into a fluid so that the lubricant lubricates one of the inner contour surface of the stator and outer contour surface of the rotor when the rotor rotates in the stator from the fluid flowing between the stator and rotor, wherein the reservoir source is disposed in one of the stator and the rotor.

2. The apparatus of claim 1, wherein the lubricating unit is placed above the rotor.

3. The apparatus of claim 1, wherein the lubricating unit is placed in the rotor or stator.

4. The apparatus of claim 1, wherein the lubricating unit discharges the lubricant between the stator and the rotor.

5. The apparatus of claim 1, wherein the lubricant is selected from a group consisting of: (i) a liquid; (ii) solid particles; (iii) a mixture of a liquid and solid particles.

6. The apparatus of claim 1, wherein the lubricating unit includes:

a pump;

a motor configured to drive the pump; and a control unit configured to operate the motor to selectively discharge the lubricant from the reservoir source thereof into a drilling fluid entering the drilling motor.

7. The apparatus of claim 6, wherein the control unit comprises a processor configured to control discharge of the lubricant from the reservoir source thereof in response to a selected parameter.

8. The apparatus of claim 7, wherein the selected parameter is selected from a group consisting of: (i) load on the drilling motor; (ii) flow rate of the drilling fluid through the drilling motor; and (iii) temperature at a selected downhole location.

9. The apparatus of claim 1, further comprising a positive displacement device.

10. The apparatus of claim 9, wherein the positive displacement device is one of a drilling motor and a Moineau pump.

11. A method of using a drilling motor in a wellbore, comprising:

deploying the drilling motor in the wellbore, the motor including a rotor inside a stator;

supplying a drilling fluid to the drilling motor to cause the rotor to rotate in the stator; and discharging a lubricant from a reservoir source using a lubricating unit associated with the drilling motor into the drilling fluid to lubricate one of the stator and the rotor during use of the drilling motor in the wellbore, wherein the reservoir source is disposed in one of the stator and the rotor.

12. The method of claim 11 further comprising placing the lubricating unit above the rotor.

13. The method of claim 11 further comprising placing the lubricating unit in one of the rotor and the stator.

14. The method of claim 11, wherein discharging the lubricant further comprises discharging the lubricant between the stator and the rotor.

15. The method of claim 11, wherein the lubricant is selected from a group consisting of: (i) a liquid; (ii) solid particles; (iii) a mixture of solid particles and a liquid.

16. The method of claim 11 further comprising controlling the discharging of the lubricant by a control unit.

17. The method of claim 16 further comprising controlling the discharging of the lubricant in response to a selected parameter.

18. The method of claim 17, wherein the selected parameter is selected from a group consisting of: (i) load on the drilling motor; (ii) flow rate of the drilling fluid through the drilling motor; and (iii) temperature at a selected downhole location.

19. The method of claim 11, wherein discharging the lubricant comprises discharging the lubricant via passages in one of the rotor and the stator.

20. A drilling system, comprising:

a bottomhole assembly;

a drilling motor in the bottomhole assembly, the drilling motor including a rotor disposed in a stator and rotated by drilling fluid flowing between the stator and rotor; and a lubricating unit configured to supply a lubricant from a reservoir source thereof into the drilling fluid to lubricate the rotor and the stator, wherein the reservoir source is disposed in one of the stator and the rotor.

21. The drilling system of claim 20 further comprising at least one sensor configured to provide a measurement relating to a parameter of interest and a processor configured to control the supply of the lubricant in response to the parameter of interest.

* * * * *